US010047454B2

(12) United States Patent
Araki et al.

(10) Patent No.: US 10,047,454 B2
(45) Date of Patent: Aug. 14, 2018

(54) PLATING APPARATUS AND PLATING METHOD

(71) Applicant: EBARA CORPORATION, Tokyo (JP)

(72) Inventors: Yuji Araki, Tokyo (JP); Jumpei Fujikata, Tokyo (JP); Masashi Shimoyama, Tokyo (JP); Mizuki Nagai, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 414 days.

(21) Appl. No.: 14/727,674

(22) Filed: Jun. 1, 2015

(65) Prior Publication Data

US 2015/0354084 A1 Dec. 10, 2015

(30) Foreign Application Priority Data

Jun. 9, 2014 (JP) ..... 2014-118554

(51) Int. Cl.
*C25D 21/12* (2006.01)

(52) U.S. Cl.
CPC ..... *C25D 21/12* (2013.01)

(58) Field of Classification Search
CPC ..... C25D 21/12
See application file for complete search history.

(56) References Cited

U.S. PATENT DOCUMENTS

2013/0075264 A1* 3/2013 Cummings ..... C25D 21/12 205/83
2014/0116884 A1 5/2014 Kang et al.

FOREIGN PATENT DOCUMENTS

| | | |
|---|---|---|
| CN | 2861189 Y | 1/2007 |
| CN | 103789818 A | 5/2014 |
| JP | S46-012574 | 3/1971 |

* cited by examiner

*Primary Examiner* — Nicholas A Smith
(74) *Attorney, Agent, or Firm* — Baker & Hostetler LLP

(57) ABSTRACT

A plating apparatus 10 includes a rectifier 18 configured to apply a DC current to a substrate, and a plating apparatus control unit 30 that instructs the rectifier 18 on a value of the DC current. The plating apparatus control unit 30 has a setting unit 32 for setting a current value, a storage unit 34 that stores a relational expression between an instructed current value on which the rectifier 18 is instructed and an actual current value which the rectifier 18 outputs in accordance with the instructed current value, a calculation unit 38 that corrects the current value set by the setting unit 32 on the basis of the above-mentioned relational expression to calculate a corrected current value, and an instruction unit 36 that instructs the rectifier 18 on the corrected current value calculated by the calculation unit 38.

4 Claims, 6 Drawing Sheets

PLATING APPARATUS AND PLATING METHOD

TECHNICAL FIELD

This application claims the benefit of priority from Japanese Patent Application No. 2014-118554 filed on Jun. 9, 2014, the contents of which are incorporated by reference herein in their entirety.

The present invention relates to a plating apparatus and a plating method for performing plating on a plated face of a substrate or the like.

BACKGROUND ART

Conventionally, a plating apparatus is used for forming a plating film on fine wiring grooves, holes, via holes, through holes or resist openings provided on the surface of a semiconductor wafer or the like and for forming bumps (projection electrodes) electrically connected to electrodes and the like of the package on the surface of the semiconductor wafer.

The plating apparatus forms the plating film on the surface of the substrate, for example, by applying a DC current to the anode and the substrate immersed in the plating solution. In the plating apparatus, a rectifier converting an AC current to the DC current is used, and the rectifier applies the DC current to the anode and the substrate (for example, refer to Japanese Patent Publication No. 46-12574).

It is known that the rectifier has inherent instrumental errors. A rectifier has an output error, for example, within ±1.3% at 2.5 A of set value. Accordingly, when an instruction of the set value is sent from the control unit of the plating apparatus to the rectifier and the rectifier outputs an output value corresponding to the set value, a value having the output error within ±1.3% is outputted as the output value.

When the plating apparatus has a plurality of plating baths, rectifiers are provided for the respective plating baths. In this case, the control unit of the plating apparatus sends, for example, instructions of the same set value to the individual rectifiers. Herein, when the output value of each rectifier has the output error within ±1.3% with respect to 2.5 A of set value, the difference in output value among the plurality of rectifiers is 2.6% of the set value at its maximum.

Recently, it is required that variation of plating film thicknesses among plating baths be suppressed. There can be a case where this requirement is not satisfied if the error is 2.6% among the rectifiers.

The present invention is devised in view of the above-mentioned problem, and an object thereof is to provide a plating apparatus and a plating method capable of applying a current closer to the desired current to a substrate.

SUMMARY OF INVENTION

According to an aspect of the present invention, a plating apparatus is provided. The plating apparatus is a plating apparatus for plating a substrate, including: a rectifier for applying a DC current to the substrate; and a plating apparatus control unit for instructing the rectifier on a value of the DC current, wherein the plating apparatus control unit has a set unit for setting a current value, a storage unit for storing a relational expression between an instructed current value on which the rectifier is instructed and an actual current value which the rectifier outputs in accordance with the instructed current value, a calculation unit for correcting the set current value on the basis of the relational expression to calculate a corrected current value, and an instruction unit for instructing the rectifier on the corrected current value.

According to another aspect of the present invention, a plating method is provided. The plating method is a plating method for plating a substrate, including: a setting step of setting a current value; a calculation step of correcting the set current value on the basis of a relational expression between an instructed current value on which a rectifier is instructed and an actual current value which the rectifier outputs in accordance with the instructed current value to calculate a corrected current value; an instruction step of instructing the rectifier on the corrected current value; and a step of applying a DC current to the substrate on the basis of the instruction.

According to the present invention, a plating apparatus and a plating method capable of applying a current closer to the desired current to a substrate can be provided.

DESCRIPTION OF EMBODIMENTS

Figure 1:
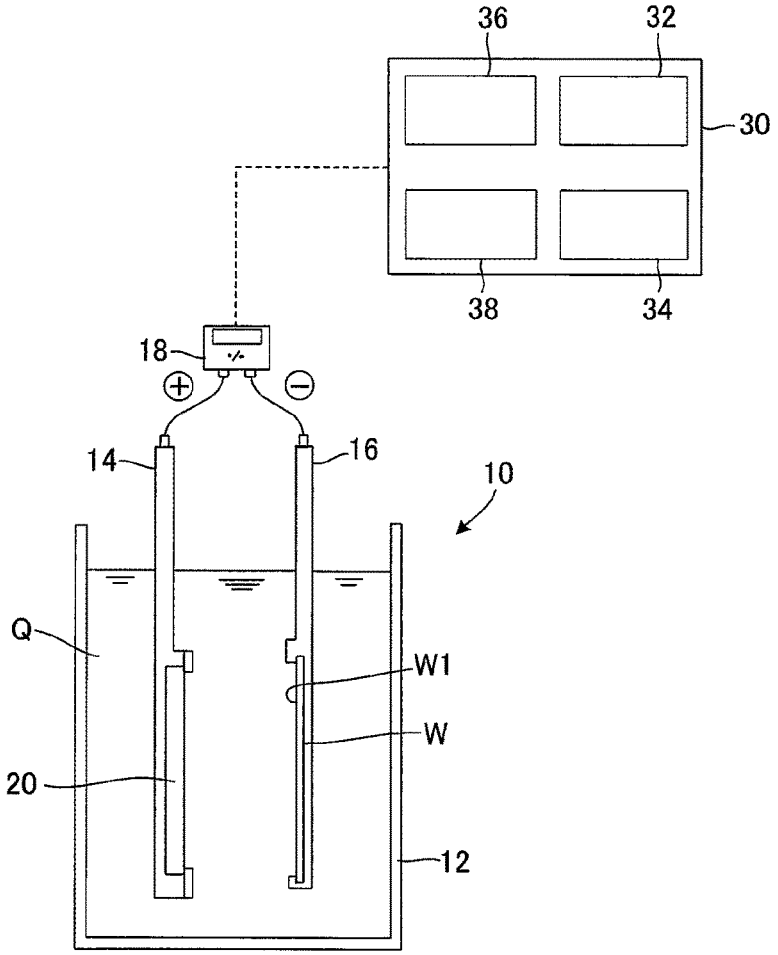
FIG. 1 is a schematic lateral cross-sectional view of a plating apparatus according to an embodiment of the present invention.

According to a first aspect of the present invention, a plating apparatus is provided. The plating apparatus is a plating apparatus for plating a substrate, including: a rectifier for applying a DC current to the substrate; and a plating apparatus control unit for instructing the rectifier on a value of the DC current, wherein the plating apparatus control unit has a set unit for setting a current value, a storage unit for storing a relational expression between an instructed current value on which the rectifier is instructed and an actual current value which the rectifier outputs in accordance with the instructed current value, a calculation unit for correcting the set current value on the basis of the relational expression to calculate a corrected current value, and an instruction unit for instructing the rectifier on the corrected current value.

According to a second aspect of the present invention, in the first aspect, the plating apparatus includes a plurality of the rectifiers, wherein the storage unit stores a plurality of the relational expressions respectively corresponding to the plurality of rectifiers, the calculation unit corrects the set current value on the basis of the plurality of relational expressions to calculate a plurality of the corrected current values, and the instruction unit instructs the plurality of rectifiers on the respective plurality of corrected current values.

According to a third aspect of the present invention, in the first aspect or the second aspect, the plating apparatus control unit has a determination unit that determines whether or not the set current value is not more than a predetermined value, and the calculation unit is configured to correct the set current value on the basis of the relational expression to calculate the corrected current value when the determination unit determines that the set current value is not more than the predetermined value.

According to a fourth aspect of the present invention, in any of the first aspect to the third aspect, the relational expression is represented by y=ax+b (a and b are constants), where x is the actual current value and y is the instructed current value, and the calculation unit sets a value y obtained by substituting the set current value for x in the relational expression to be the corrected current value.

According to a fifth aspect of the present invention, in any of the first aspect to the fourth aspect, the relational expression stored in the storage unit is obtained in advance by measuring a plurality of actual current values corresponding to a plurality of instructed current values of the rectifier.

According to a sixth aspect of the present invention, a plating method is provided. The plating method is a plating method for plating a substrate, including: a setting step of setting a current value; a calculation step of correcting the set current value on the basis of a relational expression between an instructed current value on which a rectifier is instructed and an actual current value which the rectifier outputs in accordance with the instructed current value to calculate a corrected current value; an instruction step of instructing the rectifier on the corrected current value; and a step of applying a DC current to the substrate on the basis of the instruction.

According to a seventh aspect of the present invention, in the sixth aspect, the calculation step includes correcting the set current value on the basis of a plurality of the relational expressions corresponding to a plurality of the rectifiers to calculate a plurality of the corrected current values, and the instruction step includes instructing the plurality of rectifiers on the respective calculated plurality of corrected current values.

According to an eighth aspect of the present invention, in the sixth aspect or the seventh aspect, the plating method includes a determination step of determining whether or not the set current value is not more than a predetermined value, wherein in the calculation step, the set current value is corrected on the basis of the relational expression to calculate the corrected current value when, in the determination step, it is determined that the set current value is not more than the predetermined value.

According to a ninth aspect of the present invention, in any of the sixth aspect to the eighth aspect, the relational expression is represented by y=ax+b (a and b are constants), where x is the actual current value and y is the instructed current value, and in the calculation step, a value y obtained by substituting the set current value for x in the relational expression is set to be the corrected current value.

Hereafter, embodiments of the present invention are described with reference to the drawings. FIG. 1 is a schematic lateral cross-sectional view of a plating apparatus according to an embodiment of the present invention. As illustrated in FIG. 1, a plating apparatus 10 has a plating bath 12 containing a plating solution Q, an anode holder 14 holding an anode 20, a substrate holder 16 holding a substrate W such as a semiconductor wafer, a rectifier 18 applying a DC current to the anode 20 and the substrate W, and a plating apparatus control unit 30 which can control the rectifier 18 and other elements of the plating apparatus 10.

The anode holder 14 holding the anode 20 and the substrate holder 16 holding the substrate W are immersed in the plating solution Q in the plating bath 12, and are disposed to oppose each other such that the faces of the anode 20 and the substrate W are parallel to each other. A DC current is applied by the rectifier 18 to the anode 20 and the substrate W in the state where they are immersed in the plating solution Q of the plating bath 12. By doing so, metal ions are reduced on the plated face W1 of the substrate W to form a film on the plated face W1.

The rectifier 18 is configured to apply a positive voltage to the anode 20 held on the anode holder 14 and to apply a negative voltage to the substrate W held on the substrate holder 16. By doing so, the rectifier 18 is configured to be able to apply the DC current to the anode 20 and the substrate W via the plating solution Q.

The plating apparatus control unit 30 is electrically connected to the rectifier 18. The plating apparatus control unit 30 is configured to be able to instruct the rectifier 18 on a predetermined DC current value (corrected current value). The plating apparatus control unit 30 has a setting unit 32 for setting a predetermined current value (set current value) to the plating apparatus control unit 30, a storage unit 34 storing an expression (correction expression) with which the current value thus set (set current value) is corrected, a calculation unit 38 correcting the set current value on the basis of the correction expression to calculate a current value (corrected current value), and an instruction unit 36 instructing the rectifier 18 on the corrected current value thus calculated.

The setting unit 32 is configured to set a value (current value) inputted from an input apparatus such, for example, as an external interface to the plating apparatus control unit 30. The storage unit 34 is configured of a storage medium such, for example, as a memory. The storage unit 34 stores a relational expression (correction expression) indicating relation between the current value (instructed current value) on which the rectifier 18 is instructed and a current value (actual current value) outputted by the rectifier 18 in accordance with this instructed current value. Derails of the relational expression will be mentioned later.

The calculation unit 38 corrects the current value (set current value) set by the setting unit 32 on the basis of the above-mentioned relational expression stored in the storage unit 34 to calculate the corrected current value. The rectifier 18 applies the DC current to the anode 20 and the substrate W in accordance with the corrected current value on which the plating apparatus control unit 30 (instruction unit 36) instructs.

Omitted in the figure, a plurality of plating baths 12 and a plurality of rectifiers 18 corresponding to these are included in the plating apparatus 10. The instruction unit 36 of the plating apparatus control unit 30 is configured to be able to instruct the plurality of rectifiers 18 on corrected current values. Moreover, the storage unit 34 of the plating apparatus control unit 30 stores a plurality of the above-mentioned relational expressions respectively corresponding to the plurality of rectifiers 18. Accordingly, the plating apparatus control unit 30 can correct the set current value on the basis of the plurality of relational expressions to calculate the corrected current values, and can instruct the rectifiers 18 on the respective corrected current values.

As mentioned above, the rectifier 18 has inherent instrumental errors. In the case where the plating apparatus 10 has the plurality of plating baths 12 and the plurality of rectifiers 18 as in the embodiment, even if the current values on which the individual rectifiers 18 are instructed are the same, respective output current values of the rectifiers 18 are different due to the above-mentioned instrumental errors. According to the embodiment, the plating apparatus control unit 30 corrects the set current value on the basis of the relational expressions respectively corresponding to the rectifiers 18, and instructs the rectifiers 18 on the respective corrected set current values (corrected current values). By doing so, a current close to the set current value which is a desired value can be applied to the substrate W of each plating bath 12. As a result, variation in current values of the plurality of rectifiers 18 can be suppressed, and eventually, variation in plating film thicknesses among the plating baths can be suppressed.

The relational expression stored in the storage unit 34 illustrated in FIG. 1 is obtained in advance by measuring a plurality of actual current values corresponding to a plurality of instructed current values of the rectifier 18. Table 1 exemplarily presents the instructed current values on which the rectifier 18 is instructed and measured values of currents which the rectifier 18 actually outputs with respect to these instructed current values.

TABLE 1

| Instructed current value (y) | 0.25 A | 0.50 A | 1.25 A | 2.50 A | 10.00 A |
|---|---|---|---|---|---|
| Measured value (x) | 0.243 A | 0.492 A | 1.238 A | 2.482 A | 9.949 A |

As presented in Table 1, it is apparent that the rectifier 18 in this example has instrumental errors to output currents whose values are somewhat smaller with respect to the instructed current values.

Figure 2:
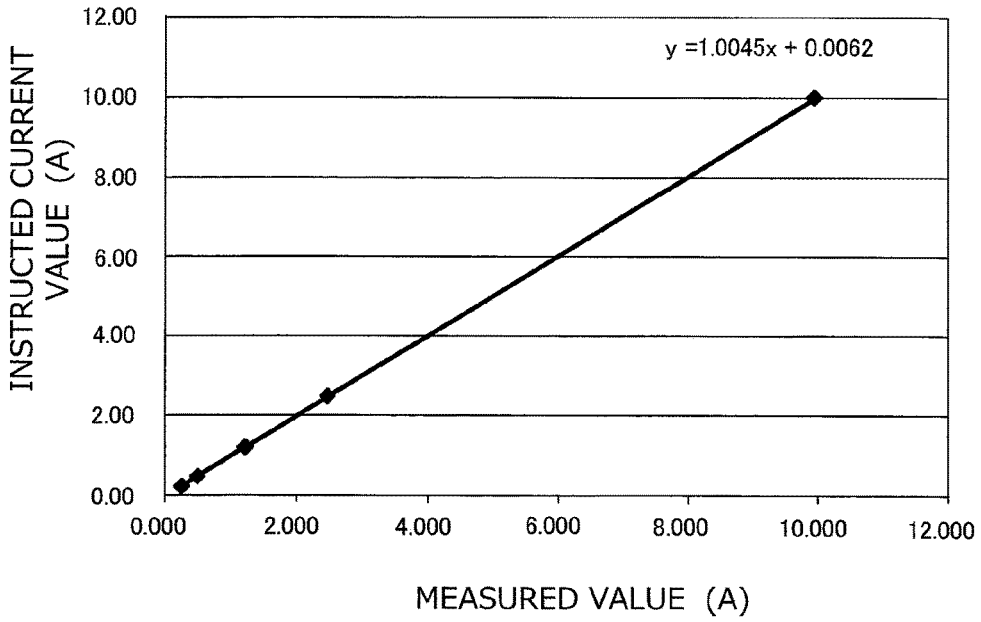
FIG. 2 is a graph illustrating relation between an instructed current value of a rectifier and a measured value.

FIG. 2 illustrates a graph in which the results in Table 1 are plotted. In the graph of FIG. 2, the vertical axis represents the instructed current value and the horizontal axis represents the measured value (actual current value). The relational expression between the instructed current value and the actual current value ($y=ax+b$; a and b are constants) is obtained by performing approximation for the results, such, for example, as the least squares method. In this example, the relational expression of $y=1.0045x+0.0062$ is obtained, where x is the actual current value and y is the instructed current value.

Since such a relational expression is typically different for each rectifier 18, the plurality of relational expressions obtained for the individual rectifiers 18 are stored in the storage unit 34 illustrated in FIG. 1. The calculation unit 38 illustrated in FIG. 1 substitutes the set current value set by the setting unit 32 for x in the plurality of relational expressions to obtain the plurality of values y. On these values y, the respective rectifiers 18 are instructed by the instruction unit 36 as the corrected current values. In other words, the set current value set by the setting unit 32 is the desired current value which is wanted to be applied to the substrate W, and the instructed current value y (corrected current value) on the basis of which a current close to this desired current value (set current value) can be applied to the substrate W is obtained on the basis of the above-mentioned relational expression. Accordingly, the rectifiers 18 are instructed on the instructed current values y (corrected current values) which are the values in consideration of the instrumental errors of the rectifiers 18. Thereby, the output current values outputted from the rectifiers 18 are to be the values close to the desired current value (set current value).

The calculation unit 38 illustrated in FIG. 1 may be configured so as to perform the correction based on the above-mentioned relational expression when the current value (set current value) set by the setting unit 32 is not more than a predetermined value and not to perform the correction when the set current value exceeds the predetermined value. When the correction is not performed on the set current value, the instruction unit 36 illustrated in FIG. 1 instructs the rectifier 18 on a value of the set current value as the instructed current value. This predetermined value is stored in advance, for example, in the storage unit 34.

When the above-mentioned relational expression is obtained by measuring the actual current values corresponding to the instructed current value from 0.25 A to 10.00 A as presented in Table 1 and FIG. 2, the above-mentioned predetermined value can be, for example, 10.00 A. Notably, the rectifier 18 has a property in which the error between the instructed current value and actual current value is smaller as the instructed current value is larger. Hence, when the set current value exceeds 10.00 A, the error between the instructed current value and the actual current value is small even if the correction is not performed, and the error only causes small influence on the plating film. As above, the correction is not performed when the set current value exceeds the predetermined value, and thereby, it is sufficient that the relational expression between the instructed current value and the actual current value is obtained only within a range of the set current value where the correction is performed.

Figure 3:
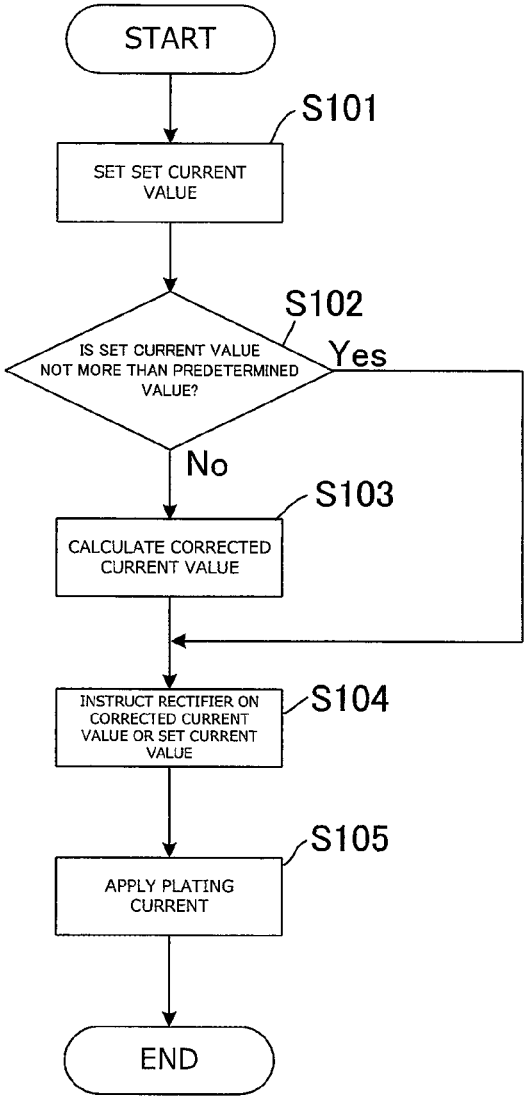
FIG. 3 is a flowchart of a plating method according to an embodiment of the present invention.
Figure 4:
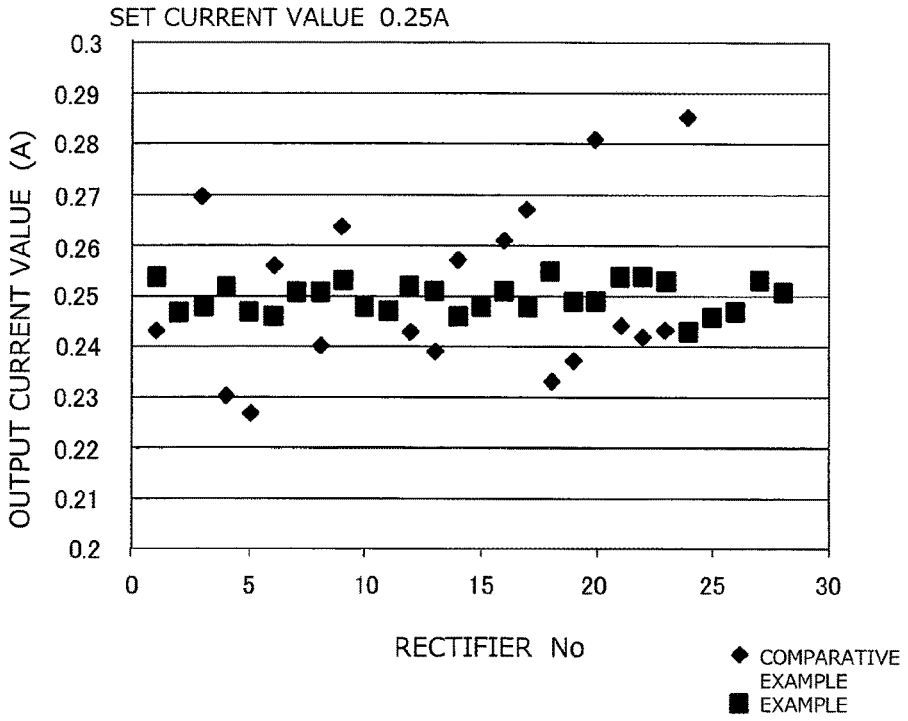
FIG. 4 is a graph of output current values of a plurality of rectifiers with respect to a predetermined set current value.
Figure 5:
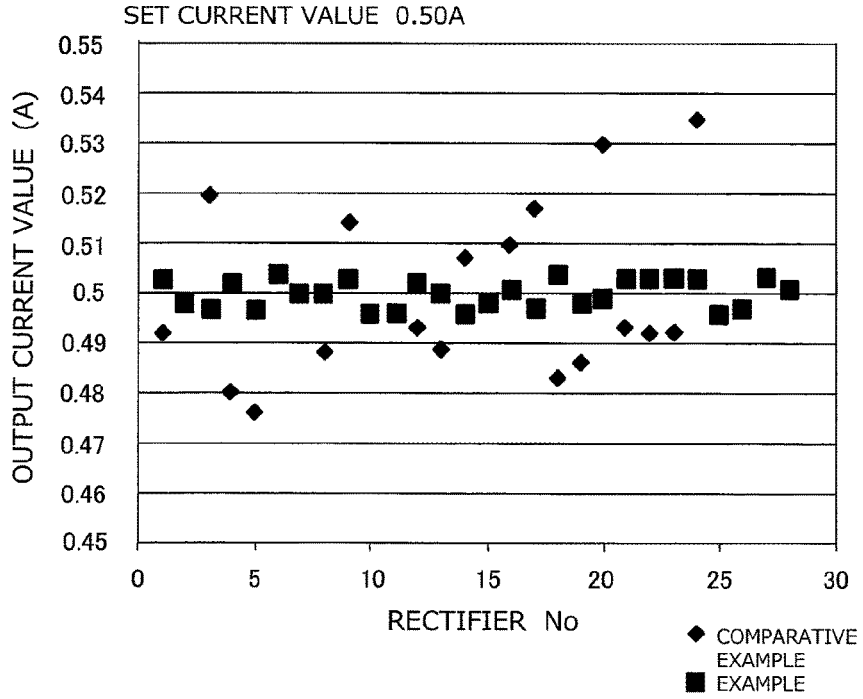
FIG. 5 is a graph of output current values of the plurality of rectifiers with respect to a predetermined set current value.
Figure 6:
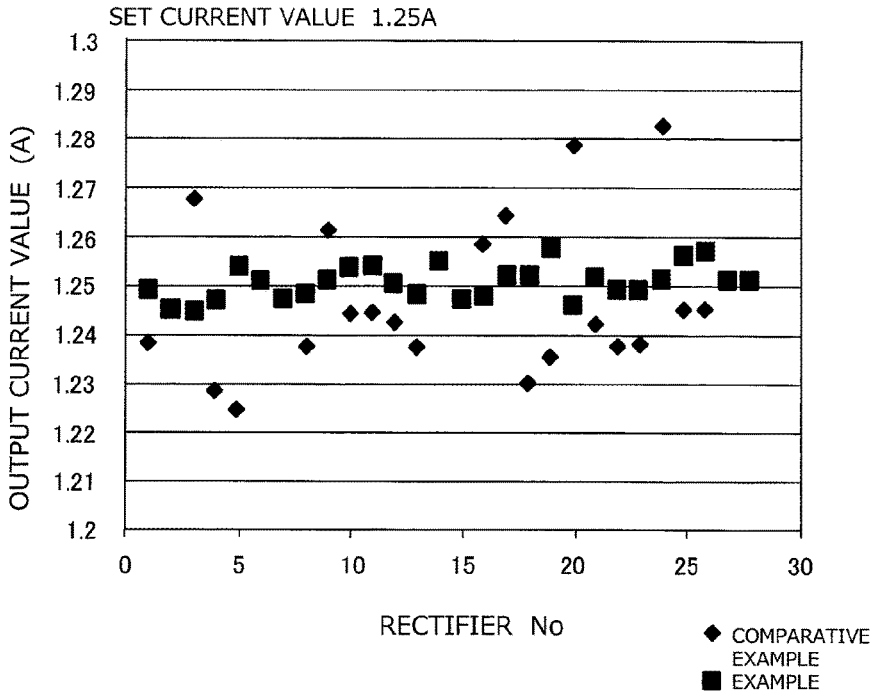
FIG. 6 is a graph of output current values of the plurality of rectifiers with respect to a predetermined set current value.
Figure 7:
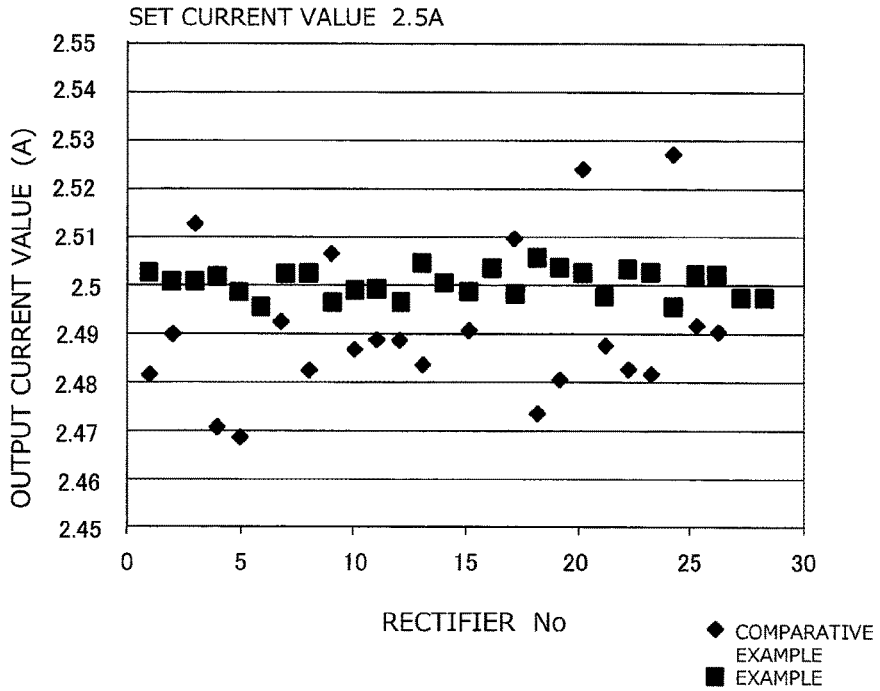
FIG. 7 is a graph of output current values of the plurality of rectifiers with respect to a predetermined set current value.
Figure 8:
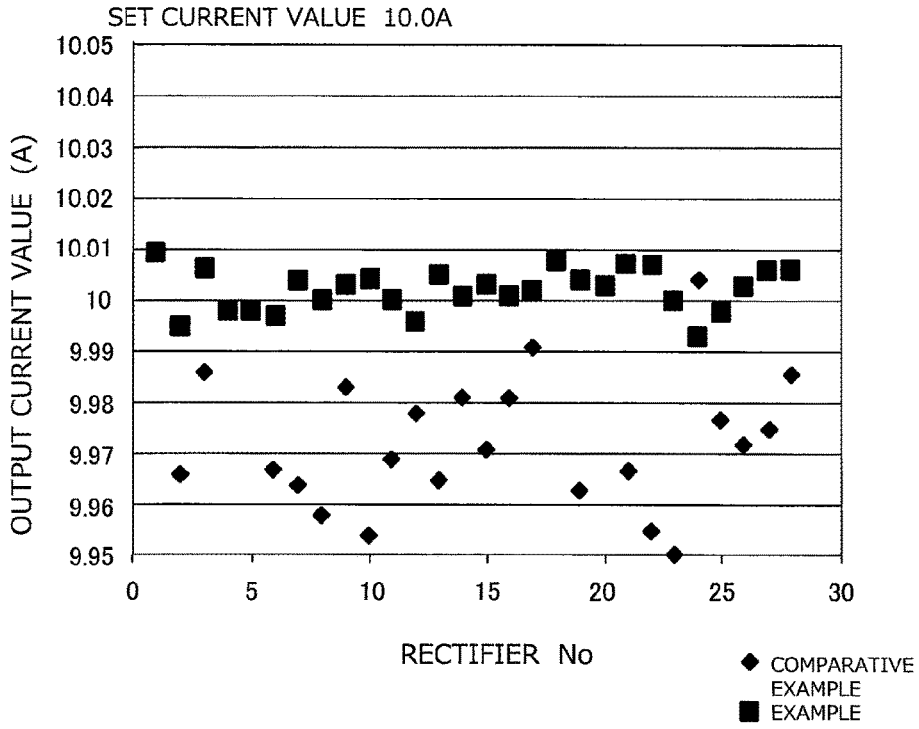
FIG. 8 is a graph of output current values of the plurality of rectifiers with respect to a predetermined set current value.

Next, a plating method according to the embodiment is described. FIG. 3 is a flowchart of the plating method according to the embodiment. First, in the plating apparatus 10 illustrated in FIG. 1, a current value is inputted from the input apparatus by a user such, for example, as an operator, and the setting unit 32 sets this set current value to the plating apparatus control unit 30 (step S101). The plating apparatus control unit 30 (determination unit) determines whether or not the set current value is not more than a predetermined value (step S102).

When it is determined that the set current value is not more than the predetermined value (step S102, No), the calculation unit 38 reads out the above-mentioned relational expression stored in the storage unit 34, and corrects the set current value on the basis of this relational expression to calculate the corrected current value (step S103). Specifically, the calculation unit 38 substitutes the set current value for x in $y=ax+b$ (a and b are constants) which is the above-mentioned relational expression to obtain the instructed current value y as the corrected current value. Notably, when there are a plurality of rectifiers 18 (plating baths 12), a plurality of corrected current values on which the respective rectifiers 18 are instructed are calculated on the basis of the relational expressions respectively corresponding to the rectifiers 18. Subsequently, the instruction unit 36 instructs the rectifier 18 on the corrected current value thus calculated (step S104). In the case of the plurality of rectifiers 18, the instruction unit 36 instructs the rectifiers 18 on the respective plurality of corrected current values thus calculated.

On the other hand, when it is determined that the set current value is larger than the predetermined value (step S102, Yes), the correction of the set current value is not performed, but the instruction unit 36 instructs the rectifier 18 on the value of the set current value (step S104).

The rectifier 18 applies the plating current (DC current) for the substrate W and the anode 20 on the basis of the instruction from the instruction unit 36 (step S105). Specifically, the rectifier 18 applies the plating current (DC current) for the substrate W and the anode 20 on the basis of the corrected current value or the set current value on which the instruction unit 36 instructs.

As mentioned above, according to the plating apparatus and the plating method according to the embodiment, the plating apparatus control unit 30 is configured to correct the set current value on the basis of the relational expression indicating the relation between the current value (instructed current value) on which the rectifier 18 is instructed and the current value (actual current value) outputted by the rectifier 18 in accordance with that current value to calculate the corrected current value and to instruct the rectifier 18 on this corrected current value. Due to this, the plating apparatus control unit 30 can instruct the rectifier 18 on the corrected current value on the basis of which the rectifier 18 can output a value close to the set current value, and a current closer to the desired current can be applied to the substrate.

Moreover, when the plating apparatus 10 includes the plurality of rectifiers 18, the plating apparatus control unit 30 calculates the plurality of corrected current values for instructing the respective rectifiers 18 on the basis of the relational expressions corresponding to the rectifiers 18, and instructs the rectifiers 18 on the respective corrected current values. By doing so, the rectifiers 18 can be instructed on the corrected current values on the basis of which the respective rectifiers 18 can output values close to the set current value, and currents closer to the desired current can be applied to the substrates W. Eventually, output difference between the plurality of rectifiers 18 can be small, and variation in plating thicknesses among the plating baths 12 can be suppressed.

Examples

Herein, the present invention is described in detail using examples. In the examples, 28 rectifiers 18 (No. 1 to No. 28) were prepared. The rectifiers 18 were instructed on the respective corrected current values calculated by correcting the set current value on the basis of the relational expressions stored in the storage unit 24 for the individual rectifiers 18, and the output current values actually outputted from the individual rectifiers 18 were measured (Examples).

For comparative examples, 18 to 23 rectifiers were prepared. The individual rectifiers were instructed on the set current value which was not corrected as it was, and the output current values actually outputted from the individual rectifiers were measured (Comparative Examples).

For both Examples and Comparative Examples, 0.25 A (amperes), 0.50 A, 1.25 A, 2.50 A and 10.0 A were respectively set as the set current values. The results in Examples and Comparative Examples for the respective set current values are illustrated in FIG. 4 to FIG. 8. In FIG. 4 to FIG. 8, the vertical axis represents the measured output current value (amperes) and the horizontal axis represents the rectifier number.

As illustrated in FIG. 4 to FIG. 8, the output current values in Examples tend to be closer to the set current value as compared with the output current values in Comparative Examples as a whole. As a result, variations of the output current values in Examples are smaller than variations of the output current values in Comparative Examples.

Table 2 presents variations of the output current values among the rectifiers in Examples and Comparative Examples illustrated in FIG. 4 to FIG. 8. Here, the variation of the output current values is a value, in percentage, obtained by dividing the difference between the maximum value and the minimum value of the output current values from each rectifier by the average of the output current values.

TABLE 2

| Variation in Output Values from Rectifiers (max-min)/average100(%) | | |
|---|---|---|
| Set current value | Comparative Example | Example |
| 0.25 A | 23.2% | 4.8% |
| 0.5 A | 11.8% | 1.6% |
| 1.25 A | 4.7% | 1.0% |
| 2.5 A | 2.3% | 0.4% |
| 10.0 A | 0.7% | 0.2% |

As presented in Table 2, it is apparent that the values of the variations in Examples are smaller as compared with the values of the variations in Comparative Examples.

As mentioned above, according to the examples, the output current values from the rectifiers can be values closer to the set current value. In addition to this, as presented in Table 2, the variation of the output values among the rectifiers can be reduced. Eventually, since the variation in values of the currents flowing in the plurality of plating baths can be reduced, the variation in plating film thicknesses among the plating baths can be suppressed.

While the embodiments of the present invention are described as above, the above-mentioned embodiments are intended to facilitate the understanding of the present invention, and are not intended to limit the present invention. The present invention may be changed or improved without departing from the spirit thereof, and may include equivalents thereof. Moreover, any combination or omission of the constituents described in the appended claims and the description is possible within a range in which at least part of the problems mentioned above can be solved or within a range in which at least part of the effects can be achieved.

REFERENCE SIGNS LIST

10 Plating apparatus
18 Rectifier
30 Plating apparatus control unit
32 Setting unit
34 Storage unit
36 Instruction unit
38 Calculation unit

What is claimed is:

1. A plating apparatus for plating a substrate, comprising:
a rectifier for applying a DC current to the substrate; and
a plating apparatus control unit for instructing the rectifier on a value of the DC current, wherein
the plating apparatus control unit has
a setting unit for setting a current value,
a storage unit for storing a relational expression between an instructed current value on which the rectifier is instructed and an actual current value which the rectifier outputs in accordance with the instructed current value,
a calculation unit for correcting the set current value on the basis of the relational expression to calculate a corrected current value, and an instruction unit for instructing the rectifier on the corrected current value, wherein the plating apparatus control unit has a determination unit that determines whether or not the set current value is not more than a predetermined value, the calculation unit is configured to correct the set current value on the basis of the relational expression to calculate the corrected current value and the instruction unit is configured to instruct the rectifier on the corrected current value when the determination unit determines that the set current value is not more than the predetermined value, and the instruction unit is configured to instruct the rectifier on the set current value when the determination unit determines that the set current value is more than the predetermined value.

2. The plating apparatus according to claim 1, comprising a plurality of the rectifiers, wherein the storage unit stores a plurality of the relational expressions respectively corresponding to the plurality of rectifiers, the calculation unit corrects the set current value on the basis of the plurality of relational expressions to calculate a plurality of the corrected current values, and the instruction unit instructs the plurality of rectifiers on the respective plurality of corrected current values.

3. The plating apparatus according to claim 1, wherein the relational expression is represented by $y=ax+b$ (a and b are constants), where x is the actual current value and y is the instructed current value, and the calculation unit sets a value y obtained by substituting the set current value for x in the relational expression to be the corrected current value.

4. The plating apparatus according to claim 1, wherein the relational expression stored in the storage unit is obtained in advance by measuring a plurality of actual current values corresponding to a plurality of instructed current values of the rectifier.

* * * * *